US012209487B1

(12) United States Patent
Al-Mousa

(10) Patent No.: US 12,209,487 B1
(45) Date of Patent: Jan. 28, 2025

(54) POWERING A PACKER AND AN ELECTRICAL SUBMERSIBLE PUMP

(71) Applicant: Saudi Arabian Oil Company, Dhahran (SA)

(72) Inventor: Ahmed Abdulaziz Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/456,950

(22) Filed: Aug. 28, 2023

(51) Int. Cl.

| | |
|---|---|
| ***E21B 43/12*** | (2006.01) |
| ***E21B 17/00*** | (2006.01) |
| ***E21B 23/06*** | (2006.01) |
| ***E21B 47/13*** | (2012.01) |

(52) U.S. Cl.
CPC ..... *E21B 43/128* (2013.01); *E21B 17/003* (2013.01); *E21B 23/06* (2013.01); *E21B 47/13* (2020.05)

(58) Field of Classification Search
CPC ..... E21B 23/06
See application file for complete search history.

(56) References Cited

U.S. PATENT DOCUMENTS

| | | | | |
|---|---|---|---|---|
| 8,733,458 | B2 | 5/2014 | Gambier et al. | |
| 2016/0061010 | A1* | 3/2016 | Sears | E21B 43/128 166/66.4 |
| 2017/0275962 | A1* | 9/2017 | Conzemius | E21B 33/1272 |

FOREIGN PATENT DOCUMENTS

| | | |
|---|---|---|
| EA | 025810 | 1/2017 |
| WO | WO 2022006420 | 1/2022 |

* cited by examiner

*Primary Examiner* — Kristyn A Hall
(74) *Attorney, Agent, or Firm* — Fish & Richardson P.C.

(57) ABSTRACT

An assembly and a method for powering a wellbore production system. The wellbore production system includes a packer, a piston assembly, an electrical submersible pump, and an electrical cable. The packer moves between an extended position and a retracted position to seal against an inner surface of a wellbore. The piston assembly is coupled to the packer. The piston assembly moves the packer between the extended position and the retracted position. The electrical submersible pump is coupled to the piston assembly. The electrical cable is coupled to the piston assembly and the electrical submersible pump. The electrical cable supplies electrical power to both the piston assembly and the electrical submersible pump.

17 Claims, 4 Drawing Sheets

POWERING A PACKER AND AN ELECTRICAL SUBMERSIBLE PUMP

TECHNICAL FIELD

This disclosure relates to electrically powering a packer and an electrical submersible pump in a wellbore, for example, one through which hydrocarbons or water are produced.

BACKGROUND

Hydrocarbons are trapped in reservoirs. Wellbores are drilled through those reservoirs to raise the hydrocarbons to the surface of the Earth. Sometimes, equipment like packers and electrical submersible pumps and are placed in the wellbore to control the flow of the hydrocarbons through the wellbore to the surface. Packers are operable to seal a production tubular to an inner surface of the wellbore. Electrical submersible pumps can flow the hydrocarbons through the production tubing from the reservoirs to the surface.

SUMMARY

This disclosure describes technologies related to powering a packer and an electrical submersible pump.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes an assembly and a method for powering a packer and an electrical submersible pump. Wellbores in an oil and gas well are filled with both liquid and gaseous phases of various fluids and chemicals including water, oils, and hydrocarbon gases. A packer and an electrical submersible pump are installed in the wellbore to seal a production tubing to an inner surface of the wellbore and to flow the fluids and gases in the wellbore from the formations of the Earth to the surface of the Earth. An electrical cable extends from the surface of the Earth to the packer and the electrical submersible pump. The electrical cable supplies electricity to power both the packer to seal the wellbore and the electrical submersible pump to pressurize fluids.

Implementations of the present disclosure realize one or more of the following advantages. Time to conduct completion operations can be reduced. For example, powering the packer and the electrical submersible pump with the same electrical cable can eliminate time required to position a second electrical cable with one cable powering one of packer and the other electrical cable powering the electrical submersible pump.

Complexity of wellbore completion operations can be reduced. For example, powering the packer and the electrical submersible pump with the same electrical cable can reduce the complexity of wellbore completion operations.

Personnel safety and environmental safety can be improved. For example, when the position of the packer needs to be shifted in response to a pressure control excursion (a kick), the position of the packer can be shifted immediately, without tripping a shifting tool or plug into the wellbore to shift the position hydraulically or mechanically, reducing risk to personnel and the environment.

Figure 1A:
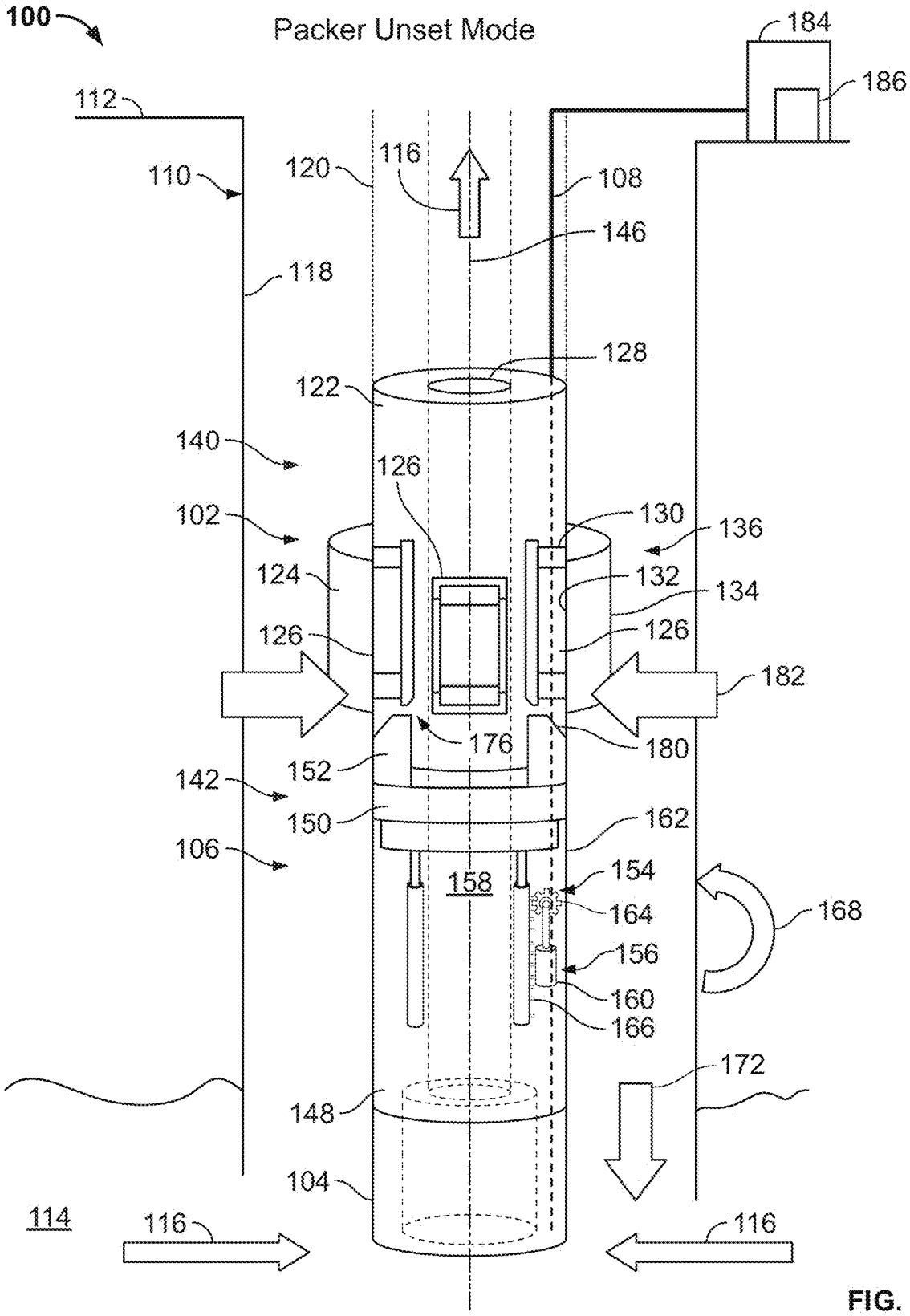
FIG. 1A is a schematic view of a wellbore production system having a packer, an electrical submersible pump, and a piston assembly with the packer in an unset mode.
Figure 1B:
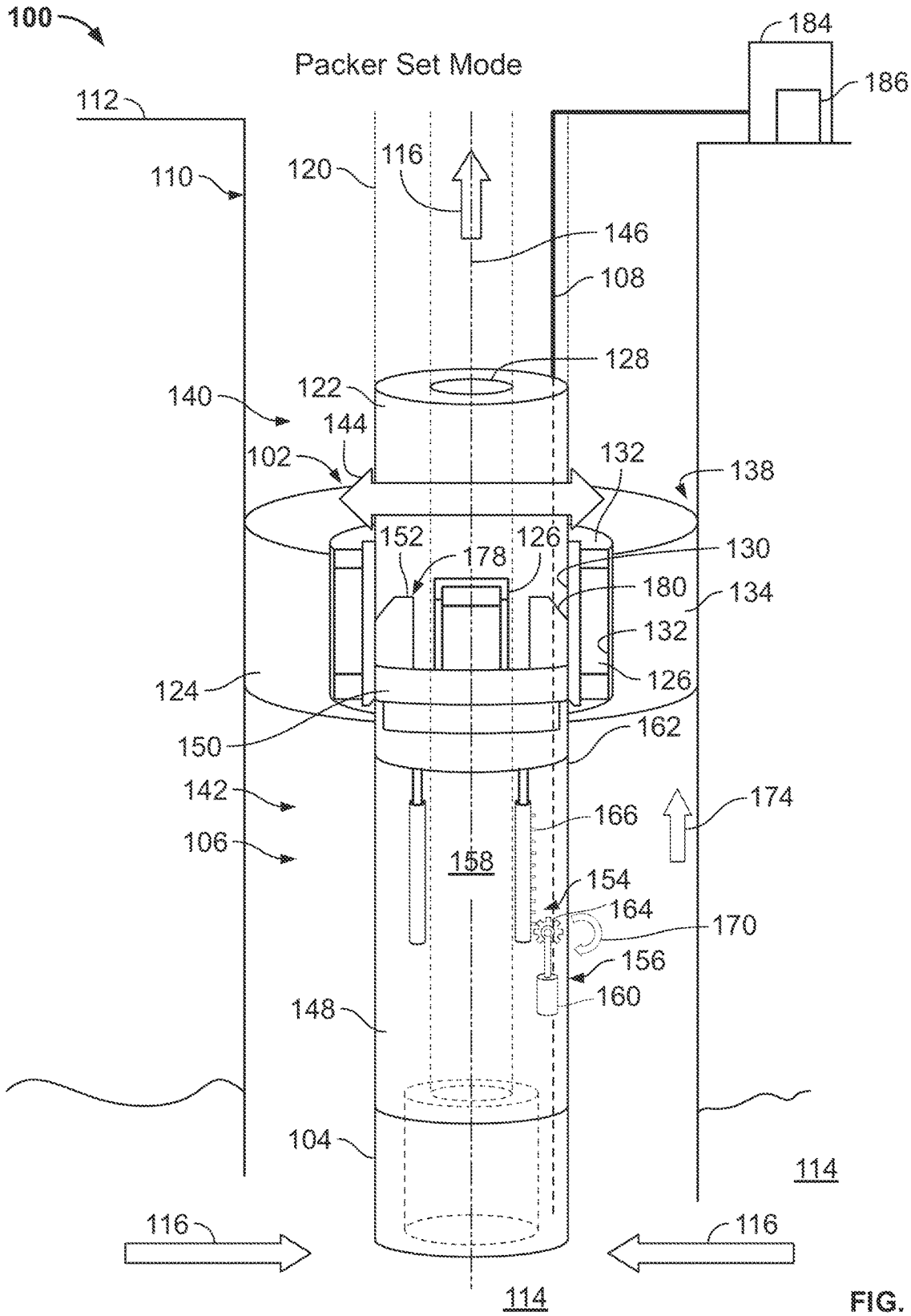
FIG. 1B is a schematic view of the wellbore production system of FIG. 1A with the packer in a set mode.

FIG. 1A is a schematic view of a wellbore production system 100 having a packer 102, an electrical submersible pump 104, and a piston assembly 106 with the packer 102 in an unset mode. FIG. 1B is a schematic view of the wellbore production system 100 with the packer 102, the electrical submersible pump 104, and the piston assembly 106 of FIG. 1A with the packer 102 in a set mode. The wellbore production system 100 has an electrical cable 108 electrically coupled to the piston assembly 106 and the electrical submersible pump 104 to supply electrical power to both the piston assembly 106 and the electrical submersible pump 104.

The wellbore production system 100 (the packer 102, the electrical submersible pump 104, and the piston assembly 106) can be disposed in a wellbore 110. The wellbore 110 extends from a surface 112 of the Earth into the formations 114 of the Earth. The formations 114 of the Earth contain liquid and gaseous phases of various fluids and chemicals including water and hydrocarbons. The wellbore 110 includes an opening 106 that allow the liquid and gaseous phases of the various fluids including water, oils, and hydrocarbon gases to flow from the formations 114 into the wellbore 110 in the direction of arrow 116 and up to the surface 112 of the Earth for transport and refinement. The wellbore 110 has an inner surface 118.

The wellbore production system 100 includes a production tubing 120 extending from the surface 112 to the packer 102. The production tubing 120 receives the fluids from the electrical submersible pump 104, the piston assembly 106, and the packer 102, then conducts the fluids to the surface 112.

Referring to FIG. 1A, the packer 102 is in a unset state. In the unset state, the packer 102 is spaced apart from the inner surface 118 of the of the wellbore 110. The packer 102 includes a cylindrical body 122, an expandable seal 124, and multiple slips 126.

The cylindrical body 122 defines an interval void 128 and apertures 130 extending from the internal voids 128 through the cylindrical body 122. The interval void 128 receives the fluids from the piston assembly 106, then conducts the fluids through the packer 102 to the production tubing 120. The each of the apertures 130 are sized to accept and pass a single slip 126 to move the expandable seal 124.

The expandable seal 124 coupled to the cylindrical body 122 and articulable by the multiple slips 126. The expandable seal 124 has an inner surface 132 and an outer surface 134. The inner surface 132 contacts the slips 126. The outer surface 134 is a sealing surface.

The expandable seal 124 moves between a first position 136 and a second position 138. In the first position 136, the expandable seal 124 is spaced apart from the inner surface 132 of the wellbore 110 (the unset state as shown in FIG. 1A). In other words, in the unset state, the outer surface 134 of the expandable seal 124 is not in contact with the inner surface 132 of the wellbore 110. In the second position 138, the expandable seal 124 is in contact with the inner surface 132 of the wellbore 110 (the set state as shown in FIG. 1B). In other words, in the set state, the outer surface 134 of the expandable seal 124 contacts the inner surface 124 of the wellbore 110. When the expandable seal 124 is in the set state in contact with the inner surface 132 of the wellbore 110, fluid in the wellbore 110 is preventing from flowing outside the packer 102 in the wellbore 110 between an uphole location 140 and a downhole location 142 relative to the packer 102 as shown in FIG. 1B.

The slips 126 move the expandable seal 124 between the first position 136 and the second position 138. The slips 126 contact the piston assembly 106 and move responsive to the piston assembly 106 actuating on the slips. The slips 126 move in an outward direction 144 away from a central axis 146 of the packer 102 to move the expandable seal 124 from the first position 136 to the second position 138 (as shown in FIG. 1B), that is the set state. The slips move in an inward direction 182 toward the central axis 146 of the packer 102 to move the expandable seal 124 from the second position 138 to the first position 136 (as shown in FIG. 1A), that is, the unset state. In some cases, the slips 126 move orthogonally relative to the central axis 146 of the packer 102.

The piston assembly 106 is coupled to the packer 102 and operates the expandable seal 124 of the packer 102 between the first position 136 and the second position 138. The piston assembly 106 is also coupled to the electrical submersible pump 104. The piston assembly 106 receives the fluids from the formations 114 from the electrical submersible pump 104 and conducts the fluids to internal void 128 of the packer 102. The piston assembly 106 is electrically coupled to the electrical cable 108 and receives electrical power from the electrical cable to operate 108.

The piston assembly 106 has a cylindrical body 148, a piston 150, a cone 152, a gear assembly 154, and a downhole power unit 156. The piston 150 is movable within the cylindrical body 148 to engage and disengage the cone 152 from the slips 126 to move the expandable seal 124 between the first position 136 and the second position 138. The downhole power unit 156 receives electricity from the electrical cable 108, converts the electrical energy into mechanical energy to operate the gear assembly 154 to move the piston 150 and the cone 152 to position the expandable seal 124.

The cylindrical body 148 has a void 158 extending through the cylindrical body 148. The void 158 receives the formation fluids from the electrical submersible pump 104. The void 158 conducts the formation fluids through the piston assembly 106 to the internal void 128 of the packer 102.

The downhole power unit 156 is coupled to the electrical cable 108 and receives electricity from the electrical cable 108. The downhole power unit 156 includes a motor 160 which is coupled to the electrical cable 108. The motor 160 converts the electricity received from the electrical cable 108 into mechanical force to operate the gear assembly 154.

The downhole power unit 156 is positioned interior to an outer surface 162 of the cylindrical body 148. The downhole power unit 156 is contained within and integrated into the cylindrical body 148 between the void 158 and the outer surface 162. The cylindrical body 148 seals and protects the downhole power unit 156 from corrosive elements contained in the fluids from the formations 114.

In some cases, the electrical cable 108 conducts command signals to the downhole power unit 156. For example, the command signals can direct the downhole power unit 156 energize the motor 160 to operate the gear assembly 154 to move the piston 150 and the cone 152.

In some cases, the electrical cable 108 conducts status signals representing a condition of the downhole power unit 156 from the downhole power unit 156. For example, the electrical cable 108 can transmit status signals representing a temperature, a pressure, a resistance, or an on/off state of the downhole power unit 156, or a position of the gear assembly 154.

The downhole power unit 156 operates to activate the slips 126 of the packer 102. Activating the slips 126 sets and unsets elements of the packer 102 such as the expandable seal 124.

The gear assembly 154 is operated by the downhole power unit 156 and transfers the mechanical force to the piston 150 and cone 152 to move the cone 152 to engage and disengage the cone 152 from the slips 126, moving the expandable seal 124 between the first position 136 and the second position 138. The gear assembly 154 has a first gear 164 and a second gear 166. The first gear 164 is coupled to the motor 160 and the second gear 166. The second gear 166 is coupled to the first gear 164 and the piston 150. The first gear 164 receives the mechanical energy from the motor 160 and transfers the mechanical energy to the second gear 166 which positions the piston 150 and the cone 152 relative to the slips 126.

In some cases, the first gear 164 is pinion and the second gear 166 is a rack. The first gear 164 can rotate counter-clockwise 168 (as shown in FIG. 1A) or clockwise 170 (as shown in FIG. 1B). Referring to FIG. 1A, when the first gear 164 rotates counter-clockwise 168, the second gear 166, the piston 150, and the cone 152 move in a downhole direction 172 away from the slips 126 and disengage from the slips 126. Referring to FIG. 1B, when the first gear 164 rotates clockwise 170, the second gear 166, the piston 150, and the cone 152 move in an uphole direction 174 toward the slips 126 and engage the slips 126.

The cone 152 extends from the piston 150 in the uphole direction 174 toward the slips 126. The cone 152 is configured to alternately engage and disengage the slips 126 to actuate the slips 126, moving the expandable seal 124 between the first position 136 and the second position 138. The cone 152 is operable between a cone-first position 176 (shown in FIG. 1A) and a cone-second position 178 (shown in FIG. 1B). Referring to FIG. 1A, when the cone 152 is in the cone-first position 176, the cone 152 is spaced apart, separated, and disengaged from the slips 126. Referring to FIG. 1B, when the cone 152 is in the cone-second position 178, the cone is engaged and in contact with the slips 126 and has moved the slips 126 to reposition the expandable seal 124 from the first position 136 to the second position 138. The cone 152 has an angle surface 180 which, when the angle surface 180 moves in and out of contact with the slips 126, moves the slips 126.

The electrical submersible pump 104 is coupled to the piston assembly 106. The electrical submersible pump 104 receives the fluids from the wellbore 102 and pressurizes the fluids. The electrical submersible pump 104 pressurizes the fluids to flow the fluids from a downhole location 182 in the wellbore 110 to the surface 112 in the uphole location 140 through the void 158 of the piston assembly 106, the internal void 128 of the packer 102, and the production tubing 120.

The electrical submersible pump 104 is electrically coupled to the electrical cable 108. The electrical submersible pump 104 receives electrical power from the electrical cable 108.

In some cases, the electrical cable 108 conducts command signals to the electrical submersible pump 104. For example, the command signals can direct the electrical submersible pump to start pumping, stop pumping, increase a rotational speed, or decrease the rotational speed.

In some cases, the electrical cable 108 conducts status signals representing a condition of the electrical submersible pump 104 from the electrical submersible pump 104. For example, the electrical cable 108 can transmit status signals representing a temperature, a pressure, a resistance, an on/off state of the electrical submersible pump 104, or a flow rate of the fluid from the formations 114 through the electrical submersible pump 104.

Referring to FIGS. 1A-1B, the wellbore production system 100 includes a controller 184 positioned at the surface 112. The controller 184 has a power supply 186. The controller 184 and the power supply 186 are coupled to the electrical cable 108. The controller 184 transmits command signals to both the piston assembly 106 and the electrical submersible pump 104 along the electrical cable 108 to operate the electrical submersible pump 104 to flow the fluids in the wellbore 110 to the surface 112 and to operate the piston assembly 104 to move the expandable seal 124 between the first position 136 and the second position 138 to seal the packer 102 to the wellbore 102. The controller 184 receives the status signals from the piston assembly 106 and the electrical submersible pump 104 via the electrical cable 108. The power supply 186 transmits electricity to both the piston assembly 154 and the electrical submersible pump 104 via the electrical cable 108.

The controller 184 can include a computer with a microprocessor. The controller 184 can include one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the piston assembly 106 and the electrical submersible pump 104. The controller 184 stores values (signals and commands) against which sensed values (signals and commands) representing the conditions of the piston assembly 106 and the electrical submersible pump 104 are compared.

Figures 2A, 2B, 2C, 2D:
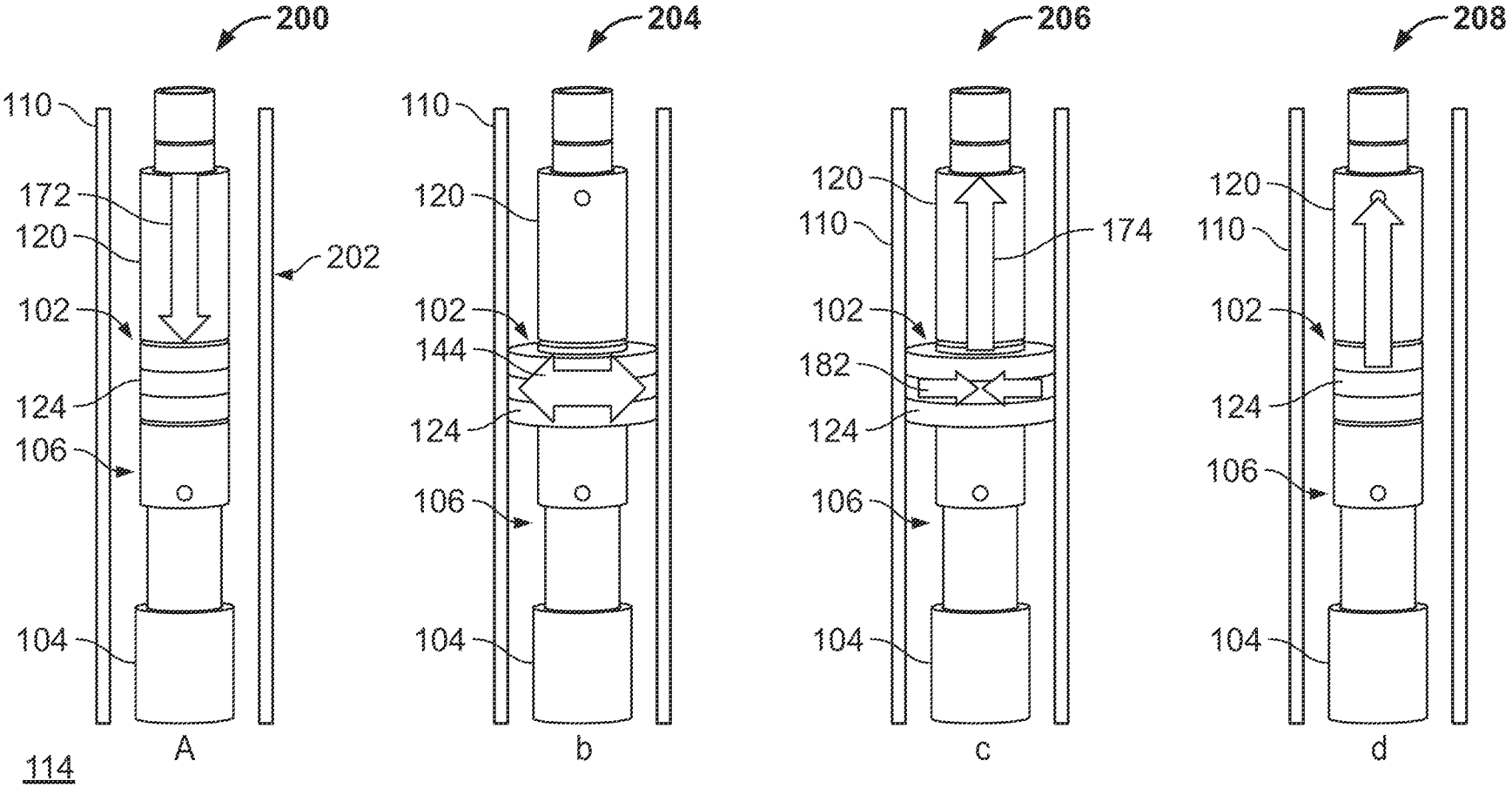
FIG. 2A is a schematic view of the packer in the unset mode and the electrical submersible pump of FIGS. 1A-1B being disposed in a wellbore.
FIG. 2B is a schematic view of the packer and the electrical submersible pump of FIGS. 1A-1B in a wellbore with the packer shifting from the unset mode to the set mode.
FIG. 2C is a schematic view of the packer and the electrical submersible pump of FIGS. 1A-1B in a wellbore with the packer shifting from the set mode to the unset mode.
FIG. 2D is a schematic view of the packer in the unset mode and the electrical submersible pump of FIGS. 1A-1B being retrieved from the wellbore.

FIGS. 2A-2D illustrate operations including deploying the wellbore production system 100 into the wellbore 110, operating the packer 102 and the electrical submersible pump 104, and retrieving the wellbore production system 100 from the wellbore 110. FIG. 2A is a schematic view of the packer in the unset mode and the electrical submersible pump of FIGS. 1A-1B being disposed in a wellbore. Referring to FIG. 2A, a deploying operation 200 is performed. The electrical submersible pump 104, the piston assembly 106, and the packer 102 are run in the wellbore 110 by the production tubing 120 connected to a rig (not shown) at the surface 112. The expandable seal 124 of the packer 102 is in the first position 136. The electrical submersible pump 104, the piston assembly 106, the packer 102, and the electrical cable 108 are positioned in the wellbore 110 at a desire depth 202 in the wellbore 110 by the rig.

FIG. 2B is a schematic view of the packer and the electrical submersible pump of FIGS. 1A-1B in a wellbore with the packer shifting from the unset mode to the set mode. Referring to FIGS. 1B and 2B, the operation 204 of setting the packer is performed. With the electrical submersible pump 104, the piston assembly 106, and the packer 102, the electrical cable 108, and the production tubing 120 held stationary in the wellbore 110 by the rig. The controller 184 transmits a command signal to the piston assembly 106 to move the expandable seal 124 of the packer 102 from the first position 136 (unset) to the second position 138 engaged to the wellbore 102, sealing the electrical submersible pump 104 such that the fluids from the formations 114 enter the electrical submersible pump 104. The command signal and the electricity to operate the piston assembly 108 are conducted via the electrical cable 108. The controller 184 can then transmit a command signal and electricity to the electrical submersible pump 104 to operate, pressurizing the fluid and conducting the fluid from the wellbore 110 to the surface 112.

FIG. 2C is a schematic view of the packer and the electrical submersible pump of FIGS. 1A-1B in a wellbore with the packer shifting from the set mode to the unset mode. Referring to FIGS. 1A and 2C, operations 206 unsetting the packer 102 are performed. The controller 184 transmits a command signal to the electrical submersible pump 104 to stop operating via the electrical cable 108. The controller 184 stops flowing electricity to the electrical submersible pump 104 on the electrical cable 108. The controller 184 transmits a command signal and electricity via the electrical cable 108 to the piston assembly 106 to move the expandable seal 124 from the second position 138 to the first position 136, disengaged from the wellbore 110.

In some cases, after the expandable seal 124 has been released by the slips 126, the expandable seal 124 may take a period of time to relax (contract). For example, the expandable seal 124 can take up to 30 minutes or even more time to relax. In such cases, packer 102 should not be move in the wellbore 110 for 30 minutes or until relaxed to ensure the expandable seal 124 does not become stuck to the wellbore 110 while pulling the packer 102 out of the wellbore 110.

FIG. 2D is a schematic view of the packer in the unset mode and the electrical submersible pump of FIGS. 1A-1B being retrieved from the wellbore. Referring to FIGS. 1A and 2D, an operation 208 to retrieve the wellbore production system 100 from the wellbore 110 is performed. The rig at the surface 112 retrieves the production tubing 120, the packer 102, the piston assembly 106, the electrical submersible pump 104, and the electrical cable 108 to the surface 112.

Figure 3:
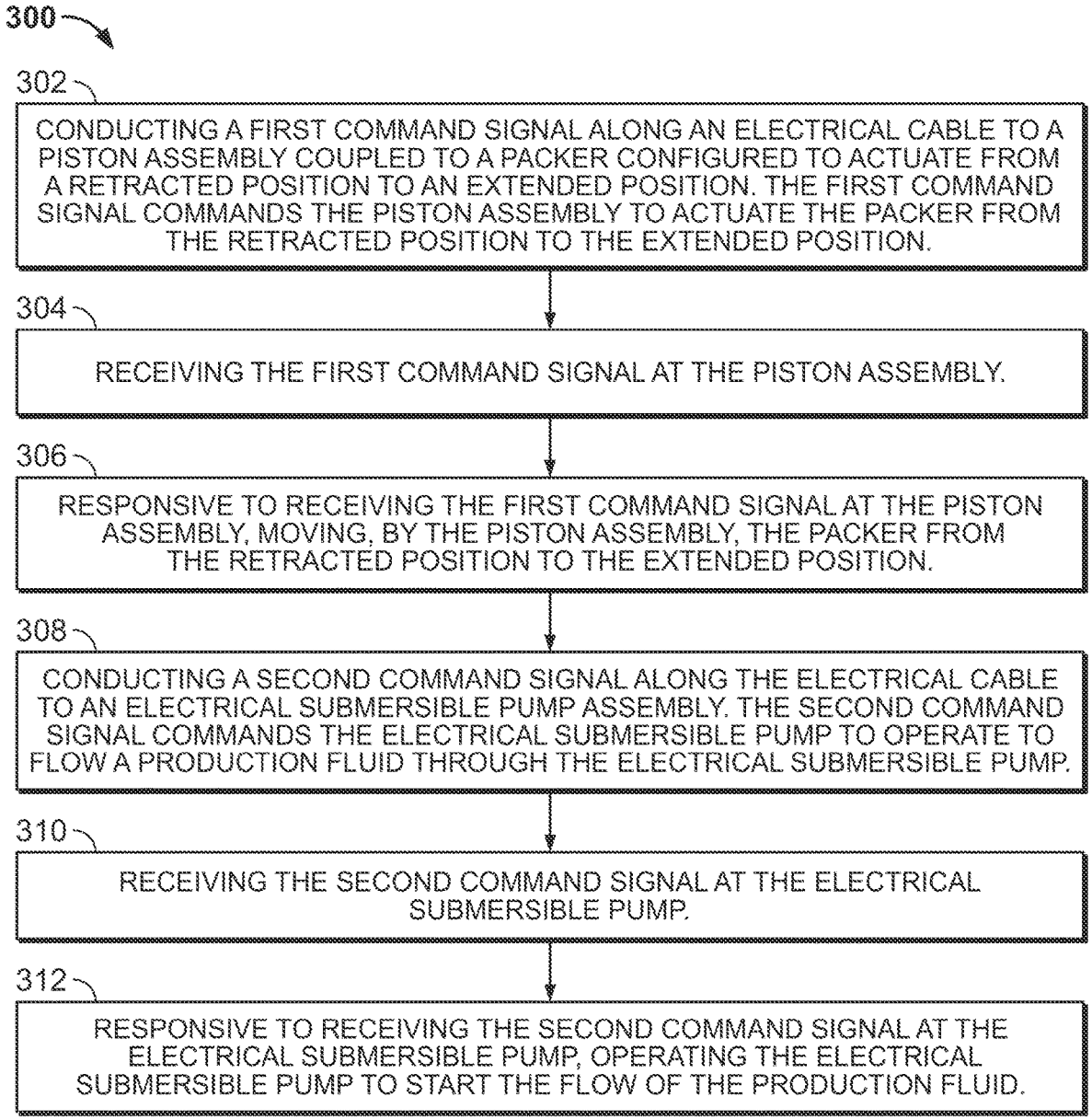
FIG. 3 is a flow chart of an example method of powering a packer and an electrical submersible pump according to the implementations of the present disclosure.

FIG. 3 is a flow chart of an example method 300 of powering a packer and an electrical submersible pump according to the implementations of the present disclosure. At 302, a first command signal is conducted along an electrical cable to a piston assembly coupled to a packer configured to actuate from a retracted position to an extended position. The first command signal commands the piston assembly to actuate the packer from the retracted position to the extended position. In some implementations, a controller operatively coupled to the piston assembly generates the first command signal. For example, referring to FIGS. 1B and 2B, the controller 184 transmits a command signal via the electrical cable 108 to the piston assembly 106 to move the expandable seal 124 to move from the first position 136 to the second position 138.

At 304, the first command signal and electricity is received at the piston assembly. For example, referring to FIGS. 1B and 2B, the electrical cable 108 conducts the command signal from the surface 112 to the piston assembly 106 in the wellbore 110. The downhole power unit 160 of the piston assembly 106 receives the command signal and electricity.

At 306, responsive to receiving the first command signal and electricity at the piston assembly, the packer is moved, by the piston assembly, from the retracted position to the extended position. For example, referring to FIGS. 1B and 2B, the motor 160 is energized, rotating the pinion 164 to move the rack 166. The piston 150 and the cone 152 move in the uphole direction 174 such that the cone 152 to contact the slips 126. Responsive to the cone 152 contact the slips 126, the slips move in the outward direction 144 extending the expandable seal 124 from the first position 136 (the retracted position) to the second position 138 (the extended position).

At 308, a second command signal and electricity is conducted along the electrical cable to an electrical submersible pump assembly. The second command signal commands the electrical submersible pump to operate to flow a production fluid through the electrical submersible pump. In some implementations, the controller is operatively coupled to the electrical submersible pump and generates the second command signal. For example, referring to FIGS. 1B and 2B, the controller 184 transmits the second command signal and electricity via the electrical cable 108.

At 310, the second command signal is received at the electrical submersible pump. For example, referring to FIGS. 1B and 2B, the electrical submersible pump 104 receives the second command signal and the electricity from the electrical cable 108.

At 312, responsive to receiving the second command signal at the electrical submersible pump, the electrical submersible pump is operated to start the flow of the production fluid. For example, referring to FIGS. 1B and 2B, the electrical submersible pump 104 pressurizes the fluid within the electrical submersible pump 104.

In some implementations, the powering the hydrocarbon production system further includes conducting a third command signal along the electrical cable to the electrical submersible pump assembly, the third command signal commanding the electrical submersible pump to operate to stop the flow of the production fluid through the electrical submersible pump; receiving the third command signal at the electrical submersible pump; responsive to receiving the third command signal at the electrical submersible pump, stopping the electrical submersible pump; conducting a fourth command signal along the electrical cable to the piston assembly, the fourth command signal commanding piston assembly to actuate the packer from the extended position to the retracted position; receiving the fourth command signal at the piston assembly; and responsive to receiving the fourth command signal at the piston assembly, moving, by the piston assembly, the packer from the extended position to the retracted position. For example, referring to FIGS. 1A and 2C, the controller 184 transmits a command signal to the electrical submersible pump 104 to stop pressurizing the fluid within the electrical submersible pump 104 and the controller 184 stops supplying electricity to the electrical submersible pump 104 via the electrical cable 108. For example, the controller 184 can transmit a command signal to the motor 160 to rotate the first gear 164 (the pinion) in the counter-clockwise direction 168, moving the second gear 166 (the rack) in the downhole direction 172, disengaging the cone 152 from the slips 126. The expandable seal 124 contracts from the second position 138 to the first position 136.

In some cases, the method further includes, before conducting the first command signal along an electrical cable to the piston assembly coupled to the packer, disposing the electrical submersible pump, the piston assembly, and the packer in a wellbore. For example, referring to FIG. 2A, the rig positions the electrical submersible pump 104, the piston assembly 106, the packer 102, and the electrical cable 108 in the wellbore 110.

In some cases, the method further includes, after moving, by the piston assembly, the packer from the extended position to the retracted position, retrieving the electrical submersible pump, the piston assembly, and the packer from the wellbore. For example, referring to FIG. 2D, the rig retrieves the electrical submersible pump 104, the piston assembly 106, the packer 102, and the electrical cable 108 from the wellbore 110.

Embodiments

In an example aspect, a wellbore production system includes a packer, a piston assembly, an electrical submersible pump, and an electrical cable. The packer is configured to move between an extended position and a retracted position to seal against an inner surface of a wellbore. The piston assembly is coupled to the packer. The piston assembly moves the packer between the extended position and the retracted position. The electrical submersible pump is coupled to the piston assembly. The electrical cable is coupled to the piston assembly and the electrical submersible pump. The electrical cable supplies electrical power to both the piston assembly and the electrical submersible pump.

In an example aspect combinable with any other example aspect, the electrical cable is configured to transmit command signals to the piston assembly and the electrical submersible pump and transmit status signals from the piston assembly and the electrical submersible pump.

In an example aspect combinable with any other example aspect, the wellbore production system includes a controller configured to perform operations including transmitting the command signals to the piston assembly and the electrical submersible pump on the electrical cable and receiving the status signals from the piston assembly and the electrical submersible pump on the electrical cable.

In an example aspect combinable with any other example aspect, the packer includes an expandable seal and multiple slips. The expandable seal is movable between the extended position and the retracted position to seal against the inner surface of the wellbore. The slips are coupled to the expandable seal. The slips are movable between a first position and a second position. Moving the slips from the first position to the second position extends the expandable seal to the extended position. Moving the slips from the second position to the first position retracts the expandable seal to the retracted position.

In an example aspect combinable with any other example aspect, the expandable seal moves orthogonally to a center axis of the packer and the piston assembly between the extended position and the retracted position. The slips move parallel to the center axis of the packer and the piston assembly between a first position and a second position.

In an example aspect combinable with any other example aspect, the piston assembly includes a downhole power unit coupled to the electrical cable. The downhole power unit has a motor move the slips between the first position and the second position.

In an example aspect combinable with any other example aspect, the piston assembly includes a first gear and a second gear. The first gear is coupled to the motor. The second gear coupled to the first gear and the slips. The second gear moves the slips between the first position and the second position.

In an example aspect combinable with any other example aspect, the first gear is a pinion and the second gear is a rack.

In an example aspect combinable with any other example aspect, the piston assembly includes a piston and a cone. The piston is coupled to the downhole power unit. The cone extends from the piston. The cone moves from a first position spaced apart from the slips to a second position engaged to the slips. Responsive to the cone moving from the first position spaced apart from the slips to the second position engaged to the slips, the slips move from the first position to the second position, extending the expandable seal to the extended position.

In an example aspect combinable with any other example aspect, when the cone is in the second position engaged to the slips, the slips move from the second position engaged to the cone to the first position spaced apart from the cone. Responsive to the slips moving from the second position engaged to the cone to the first position spaced apart from the cone, the expandable seal moves to the retracted position.

In an example aspect, hydrocarbon production method includes conducting a first command signal along an electrical cable to a piston assembly coupled to a packer configured to actuate between a retracted position to an extended position, the first command signal commanding the piston assembly to actuate the packer from the retracted position to the extended position; receiving the first command signal at the piston assembly; responsive to receiving the first command signal at the piston assembly, moving, by the piston assembly, the packer from the retracted position to the extended position; conducting a second command signal along the electrical cable to an electrical submersible pump assembly, the second command signal commanding the electrical submersible pump to operate to flow a production fluid through the electrical submersible pump; receiving the second command signal at the electrical submersible pump; and responsive to receiving the second command signal at the electrical submersible pump, operating the electrical submersible pump to start the flow of the production fluid.

In an example aspect combinable with any other example aspect, the hydrocarbon production method includes generating, by a controller operatively coupled to the piston assembly and the electrical submersible pump, the first command signal and the second command signal.

In an example aspect combinable with any other example aspect, the hydrocarbon production method includes conducting a third command signal along the electrical cable to the electrical submersible pump assembly, the third command signal commanding the electrical submersible pump to operate to stop the flow of the production fluid through the electrical submersible pump; receiving the third command signal at the electrical submersible pump; responsive to receiving the third command signal at the electrical submersible pump, stopping the electrical submersible pump; conducting a fourth command signal along the electrical cable to the piston assembly, the fourth command signal commanding piston assembly to actuate the packer from the extended position to the retracted position; receiving the fourth command signal at the piston assembly; and responsive to receiving the fourth command signal at the piston assembly, moving, by the piston assembly, the packer from the extended position to the retracted position.

In an example aspect combinable with any other example aspect, the hydrocarbon production method includes before conducting the first command signal along an electrical cable to the piston assembly coupled to the packer, disposing the electrical submersible pump, the piston assembly, the packer, and the electrical cable in the wellbore.

In an example aspect combinable with any other example aspect, the hydrocarbon production method includes after moving, by the piston assembly, the packer from the extended position to the retracted position, retrieving the electrical submersible pump, the piston assembly, the packer, and the electrical cable from the wellbore.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore production system comprising:

a packer configured to move between an extended position and a retracted position to seal against an inner surface of a wellbore;

a plurality of slips;

a piston assembly coupled to the plurality of slips, the piston assembly configured to move the packer, by the plurality of slips, between the extended position and the retracted position;

an electrical submersible pump coupled to the piston assembly; and an electrical cable coupled to the piston assembly and the electrical submersible pump, the electrical cable configured to supply electrical power to both the piston assembly and the electrical submersible pump.

2. The wellbore production system of claim 1, wherein the electrical cable is further configured to:

transmit command signals to the piston assembly and the electrical submersible pump; and transmit status signals from the piston assembly and the electrical submersible pump.

3. The wellbore production system of claim 2, further comprising a controller configured to perform operations comprising:

transmitting the command signals to the piston assembly and the electrical submersible pump on the electrical cable; and receiving the status signals from the piston assembly and the electrical submersible pump on the electrical cable.

4. The wellbore production system of claim 1, wherein the packer further comprises:

an expandable seal movable between the extended position and the retracted position to seal against the inner surface of the wellbore, the plurality of slips coupled to the expandable seal, the plurality of slips movable between a first position and a second position, wherein the plurality of slips is configured to:

move from the first position to the second position to extend the expandable seal to the extended position; and move from the second position to the first position to retract the expandable seal to the retracted position.

5. The wellbore production system of claim 4, wherein:

the expandable seal is configured to move orthogonally to a center axis of the packer and the piston assembly between the extended position and the retracted position; and the plurality of slips is configured to move parallel to the center axis of the packer and the piston assembly between the first position and the second position.

6. The wellbore production system of claim 4, wherein the piston assembly further comprises a downhole power unit coupled to the electrical cable, the downhole power unit comprising a motor configured move the plurality of slips between the first position and the second position.

7. The wellbore production system of claim 6, wherein the piston assembly further comprises:

a first gear coupled to the motor; and a second gear coupled to the first gear and the plurality of slips to move the slips between the first position and the second position.

8. The wellbore production system of claim 7, wherein the first gear comprises a pinion and the second gear comprises a rack.

9. The wellbore production system of claim 6, wherein the piston assembly further comprises:

a piston coupled to the downhole power unit; and a cone extending from the piston, the cone configured to move from a first position spaced apart from the plurality of slips to a second position engaged to the plurality of slips, wherein:

responsive to the cone moving from the first position spaced apart from the plurality of slips to the second position engaged to the plurality of slips, the plurality of slips move from the first position to the second position, and extend the expandable seal to the extended position.

10. The wellbore production system of claim 9, wherein:

when the cone is in the second position engaged to the plurality of slips, the plurality of slips move from the second position engaged to the cone to the first position spaced apart from the cone; and responsive to the plurality of slips moving from the second position engaged to the cone to the first position spaced apart from the cone, moving the expandable seal to the retracted position.

11. A hydrocarbon production method comprising:

conducting a first command signal along an electrical cable to a piston assembly, the piston assembly configured to operate a plurality of slips, the plurality of slips configured to actuate a packer between a retracted position to an extended position, the first command signal commanding the piston assembly to actuate the packer from the retracted position to the extended position;

receiving the first command signal at the piston assembly;

responsive to receiving the first command signal at the piston assembly, moving the plurality of slips;

responsive to moving the plurality of slips, moving the packer from the retracted position to the extended position;

responsive to moving the packer from the retracted position to the extended position, sealing the packer to an inner surface of a wellbore;

after sealing the packer to the inner surface of the wellbore, conducting a second command signal along the electrical cable to an electrical submersible pump, the second command signal commanding the electrical submersible pump to operate to flow a production fluid through the electrical submersible pump;

receiving the second command signal at the electrical submersible pump; and responsive to receiving the second command signal at the electrical submersible pump, operating the electrical submersible pump to start the flow of the production fluid.

12. The hydrocarbon production method of claim 11, further comprising generating, by a controller operatively coupled to the piston assembly and the electrical submersible pump, the first command signal and the second command signal.

13. The hydrocarbon production method of claim 11, further comprising:

conducting a third command signal along the electrical cable to the electrical submersible pump, the third command signal commanding the electrical submersible pump to operate to stop the flow of the production fluid through the electrical submersible pump;

receiving the third command signal at the electrical submersible pump;

responsive to receiving the third command signal at the electrical submersible pump, stopping the electrical submersible pump;

conducting a fourth command signal along the electrical cable to the piston assembly, the fourth command signal commanding the piston assembly to actuate the packer from the extended position to the retracted position;

receiving the fourth command signal at the piston assembly; and responsive to receiving the fourth command signal at the piston assembly, moving, by the piston assembly, the packer from the extended position to the retracted position.

14. The hydrocarbon production method of claim 13, further comprising, before conducting the first command signal along the electrical cable to the piston assembly coupled to the packer, disposing the electrical submersible pump, the piston assembly, the plurality of slips, the packer, and the electrical cable in the wellbore.

15. The hydrocarbon production method of claim 14, further comprising, after moving, by the piston assembly, the packer from the extended position to the retracted position, retrieving the electrical submersible pump, the piston assembly, the plurality of slips, the packer, and the electrical cable from the wellbore.

16. The hydrocarbon production method of claim 11, wherein moving, by the plurality of slips, the packer comprises:

moving the plurality of slips from a first position spaced apart from the packer to a second position contacting the packer;

responsive to moving the plurality of slips to the second position contacting the packer, extending an expandable seal of the packer to the extended position; and responsive to extending the expandable seal of the packer to the extended position, sealing the packer to the inner surface of the wellbore.

17. The hydrocarbon production method of claim 16, wherein moving, by the plurality of slips, the packer further comprises:

moving the plurality of slips from the second position contacting the packer to the first position spaced apart from the packer;

responsive to moving the plurality of slips to the first position spaced apart from the packer, retracting the expandable seal of the packer to the retracted position; and responsive to retracting the expandable seal of the packer to the retracted position, moving the expandable seal out of contact with the inner surface of the wellbore.

* * * * *